United States Patent [19]

Eriksson

[11] 4,284,247

[45] Aug. 18, 1981

[54] APPARATUS FOR DEFIBRATING AND CONDITIONING NONFLOWABLE CELLULOSIC MATERIAL

[76] Inventor: Erik F. Eriksson, Ymsenvagen 9, 1 tr., 121 42 Johanneshov, Sweden

[21] Appl. No.: 3,187

[22] Filed: Jan. 15, 1979

Related U.S. Application Data

[63] Continuation-in-part of Ser. No. 965,813, Dec. 4, 1978, abandoned.

[30] Foreign Application Priority Data

Dec. 6, 1977 [SE] Sweden ..... 7713845

[51] Int. Cl.[3] ..... B02C 18/30

[52] U.S. Cl. ..... 241/260.1; 241/261

[58] Field of Search ..... 366/85, 90; 425/204, 425/205; 241/260.1, 247, 190, 187, 28, 261, 204

[56] References Cited

U.S. PATENT DOCUMENTS

| | | | |
|---|---|---|---|
| 2,170,303 | 8/1939 | Helstrop | 241/204 X |
| 2,502,563 | 4/1950 | Goodchild | 366/85 X |
| 2,693,348 | 11/1954 | Ellermann | 241/260.1 X |

FOREIGN PATENT DOCUMENTS

| | | | |
|---|---|---|---|
| 1503019 | 11/1967 | France | 425/204 |
| 314288 | 12/1969 | Sweden | 241/260.1 |
| 333095 | 6/1971 | Sweden | 241/261 |

*Primary Examiner*—Mark Rosenbaum

[57] ABSTRACT

An apparatus is provided for the defibration and conditioning of nonflowable cellulosic material, comprising a housing having an inlet and an outlet and a flow chamber for cellulose material therebetween; two screws disposed in the chamber and extending from the inlet to the outlet, the screws having interdigitating helical blades with opposed pitches, and helical grooves therebetween receiving the helical blades of the opposite screws; the screws being arranged for interdigitating rotational movement in opposite directions, so as to defibrate and condition cellulosic material in the bite therebetween while carrying the material through the flow chamber from the inlet towards the outlet; at least a portion of the outer periphery of each helical blade being undulating in a plurality of successive recesses and projections, intermeshing short of contact with a like plurality of projections and recesses defining a land area in the groove of the opposite blade of the other screw, so that within the land areas in the bite of the screws the intermeshing projections of one groove occupy at least part of the recesses in the blade of the other screw to extend the filled-in area of the blade surface along each screw, for improved screw efficiency in defibration and conditioning of the cellulosic material, and transport of the material through the flow chamber.

20 Claims, 10 Drawing Figures

APPARATUS FOR DEFIBRATING AND CONDITIONING NONFLOWABLE CELLULOSIC MATERIAL

This application is a continuation in part of Ser. No. 965,813 filed Dec. 4, 1978, and now abandoned.

Nonflowable cellulosic material is commonly subjected to rolling, kneading, compression, shearing and mixing operations leading to defibration in apparatus having a housing with an inlet and an outlet and a flow chamber for cellulose material therebetween, and with two screws in the chamber, the screws having interdigitating helical blades with opposed pitches, and helical grooves therebetween receiving the helical blades of the opposite screw. The screws are arranged for interdigitating rotational movement in opposite directions so as to work the cellulosic material in the bite between the screws, and at the same time carry the cellulosic material through the flow chamber from the inlet towards the outlet.

The helical blades on such screws are usually in several sections. In the first section, the pitch of the screw decreases in the direction towards the outlet end of the housing. In the next section towards the outlet from the housing the pitch of the screw is constant, but smaller than the pitch of any part of the first section. The periphery of the helical blade is provided with one or more recesses in that section, so as to subject the cellulosic material to local radial compression against the sides and bottom of the groove between the helical blade portions of the opposite screw. A typical apparatus of this type is shown in Swedish Pat. No. 333,095.

In this way, the cellulosic material is subjected to a rolling, kneading, shearing and mixing operation in the bite between the helical blades of the screws, being pressed against the sides of the blades, as well as against the bottom of the grooves in which the opposing blades fit. In the course of this working of the cellulosic material, it is separated into individual cellulose fibers, i.e., defibrated, and the working is adjusted so as to provide cellulose fibers of the desired length, according to the properties required for the intended use.

The recesses in the external periphery of the helical blades make it possible to carry the cellulosic material more readily into the grooves between the helical blade portions of the opposite screw, and at the same time subject the cellulose material to local radially directed compression between the edge surface of the helix and the base of the groove. The result is that the material is not only defibrated but also subjected to a conditioning. The term "conditioning" refers to the permanent crimping or curling imparted to the fibers, so as to provide a felt of randomly oriented fibers with a greater spacing therebetween and a consequent lower density, due to the crimped or curled configuration of the individual fibers.

A mass of such fibers has a lower density and a higher volume per unit weight, suiting the fibrous mass especially for use as absorbent material, sanitary napkins, and also air-permeable nonwoven fibrous sheets used in the manufacture of multilayer sacks and bags. The permanent crimp imparted to the fibers gives to such nonwoven fibrous sheets an increase in stretchability of from 20 to 40% and an increase in tear factor of from 10 to25%. It is quite desirable that the inner layers of multilayer bags or sacks be able to stretch without rupture, so that the outer layers of the bag can withstand the loads to which the bag is subjected during use.

While this type of apparatus is well thought of because of the desirable properties of the products that are obtained thereby, the radial compression to which the cellulosic material is subjected in the bite of the screws is often insufficient. This is because a nice balance has to be struck between the size of the recesses and/or projections of the periphery of the blades, and the transport or flow capacity of the apparatus. The larger the recesses, the more the flow of the cellulosic material through along the screws is interfered with and slowed down, due to lack of continuity in the blade surface, although at the same time large recesses give a better radial compression, because they are better capable of carrying the cellulosic material down into the grooves. A chosen recess size may give desirable compression with one batch of cellulosic material and undesirable insufficient compression with another. Thus, the balance required between compressability and transport rate or flow rate through the apparatus may result in a compromise in which neither the flow rate nor the radial compression is adequate.

The present invention attacks these difficulties by providing apparatus for the defibration and conditioning of nonflowable cellulosic material comprising a housing having an inlet and an outlet and a flow chamber for cellulose material therebetween; two screws disposed in the chamber and extending from the inlet to the outlet, the screws having interdigitating helical blades with opposed pitches, and helical grooves therebetween interdigitatingly receiving the helical blades of the opposite screws; the screws being arranged for interdigitating rotational movement in opposite directions, so as to defibrate and condition cellulosic material in the bite therebetween while carrying the material through the flow chamber from the inlet towards the outlet; at least a portion of the outer periphery of each helical blade being undulating in a plurality of successive recesses and projections, intermeshing short of contact with a like plurality of projections and recesses defining a land area in the groove of the opposite blade of the other screw, so that within the land areas in the bite of the screws the intermeshing projections of one groove occupy at least part of the recesses in the blade of the other screw to extend the filled-in area of the blade surface along each screw, for improved screw efficiency in defibration and conditioning of the cellulosic material, and transport of the material through the flow chamber.

By filling in the space of the recesses in the bite of the screws, the amount of cellulosic material which tends to circle or wind around the screws instead of moving towards the outlet during slow flow is reduced. An increase in the pressure directed axially along the flow chamber is obtained, due to an increase in the flow rate along the screws, while the size of the recesses can be larger than usual, for an improved working effect, while the recesses and projections are not intermeshed with projections and recesses in the grooves on the other screw. The result is that larger recesses can be used than was previously the case, without impairing flow capacity or radial compression.

Furthermore, the intermeshing of like projections and recesses in the helical blades and grooves of opposed screws makes possible an additional stage of radial compression at the peripheries of the blades between the intermeshing projections and recesses themselves, as well as the usual one between the sides of the blades. This further compression provides an additional conditioning effect, and therefore an increased capacity of the apparatus in this respect as well.

Several preferred embodiments of the invention are shown in the drawings, in which.

Figure 3:
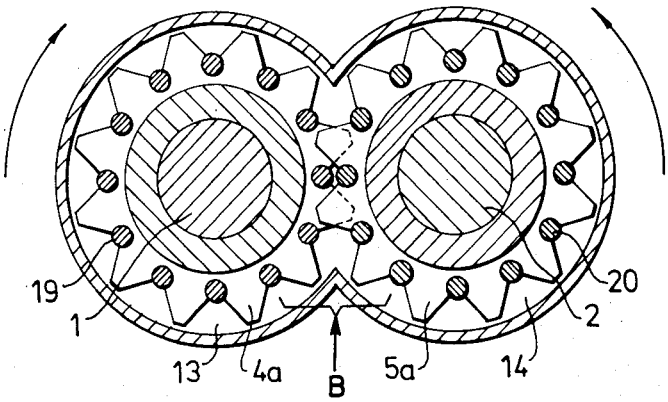
Figure 4:
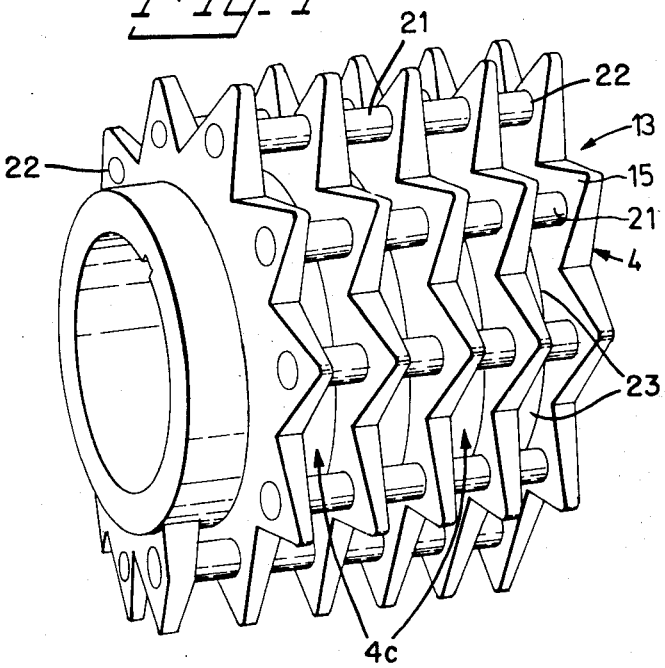
Figure 5:
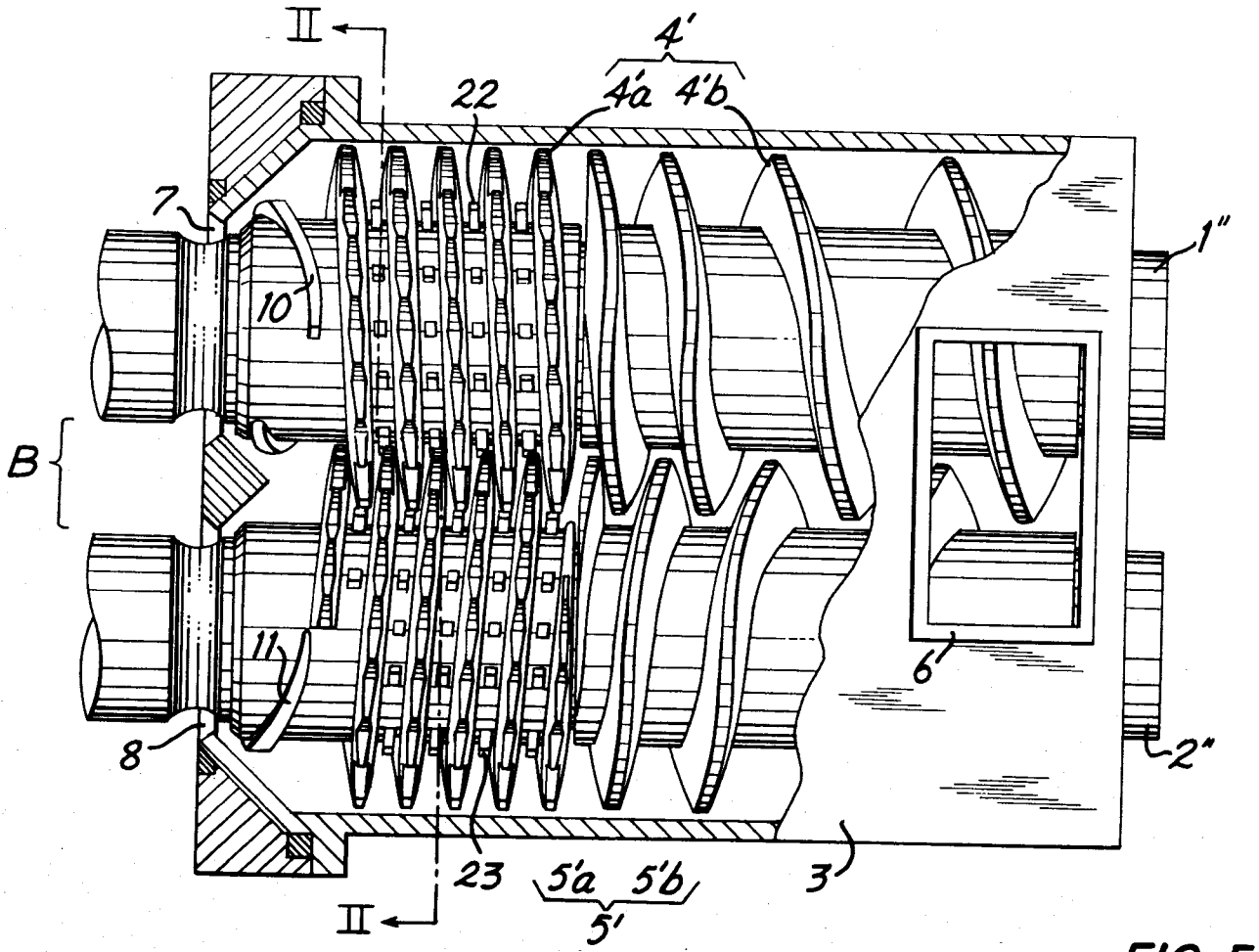
Figure 6:
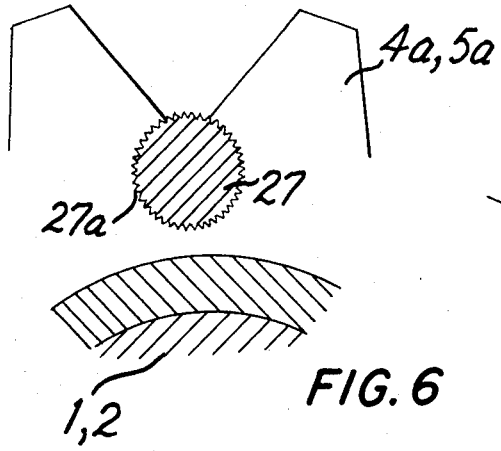
Figure 7:
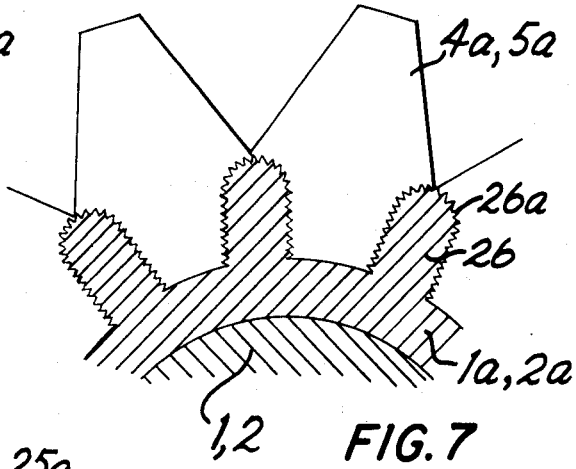
Figure 8:
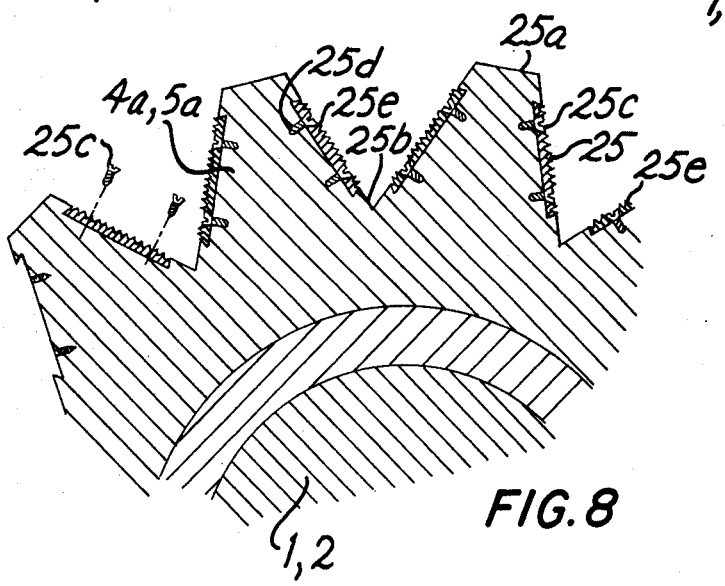
Figure 9:
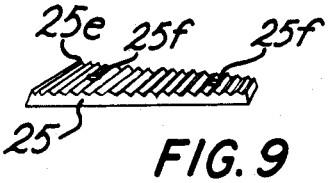
Figure 10:
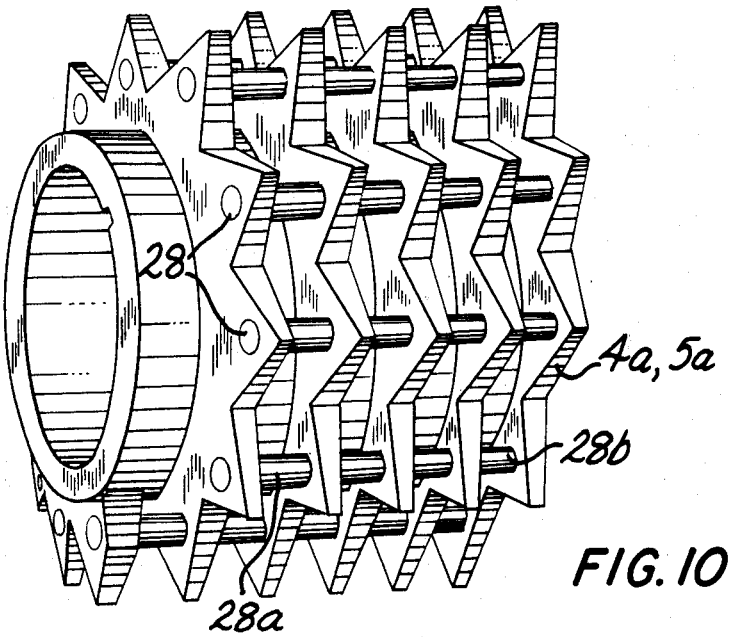

FIG. 3 is a cross-sectional view of another embodiment of defibration and conditioning apparatus, in which the intermeshing set of recesses and projections define a land area in the grooves that is spaced from the bottom of the grooves, and is in the form of rods extending axially between adjacent helical blade portions opposite the base of recessed portions of the blades, and serving as projections, and spaces between the rods serving as recesses;

FIG. 4 shows in perspective a section of a helical screw of another embodiment of the invention, in which the projections are also in the form of rods, but are placed even further away from the bottom of the grooves, extending axially between adjacent helical portions of the helical blade, rather than opposite the base of recessed portions of the blades, as in FIG. 3;

FIG. 5 shows in perspective a section of a helical screw of another embodiment of the invention, in which the projections extend upwardly into and only part way across the groove and are attached to the screw shaft;

FIG. 6 shows in cross-section another embodiment of helical screw of the invention in which the projections are in the form of axial rods as in FIG. 3, and are provided with integral axial serrations;

FIG. 7 shows in cross-section another embodiment of helical screw of the invention in which the projections extend upwardly from the base of the grooves as in FIG. 7 and are provided with integral axial serrations;

FIG. 8 shows in cross-section another embodiment of helical screw of the invention in which the blades have removable serrated portions along their sides;

FIG. 9 shows in perspective one of the removable serrated portions of FIG. 8; and FIG. 10 shows in perspective a section of helical screw in which the projections are in the form of axial rods as in FIG. 4 and increase in size in the direction towards the outlet of the chamber.

Figure 1:
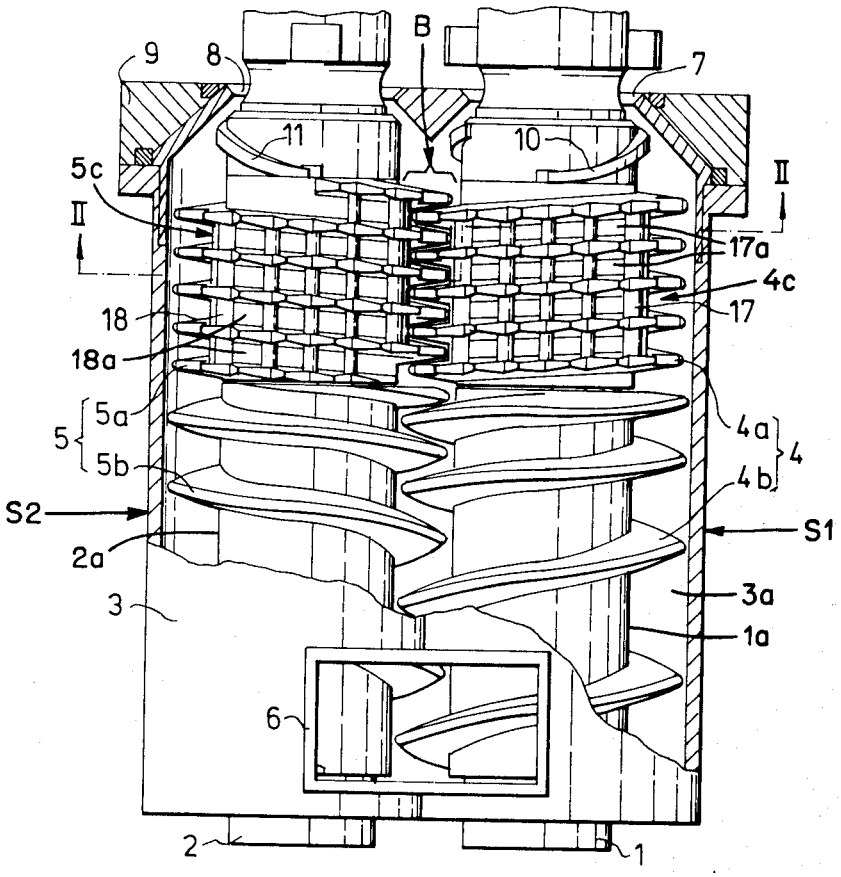
FIG. 1 is a plan view of an apparatus for the defibration and conditioning of nonflowable cellulosic material, such as cellulose pulp, in which the intermeshing set of recesses and projections in the helical grooves of each screw are provided at the base of the grooves by an undulating surface on a cylinder enclosing the screw shaft.
Figure 2:
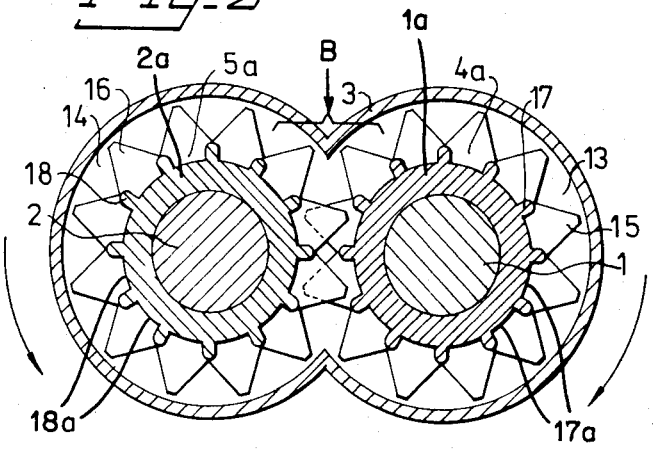
FIG. 2 is a cross-sectional view taken along the line II—II of FIG. 1.

The twin helical screws S1,S2 shown in FIG. 1 are mounted on screw shafts 1,2, which are arranged in parallel to each other for rotation in opposite directions as indicated by the arrows in FIG. 2, and are operated using a gear system and motor not shown in the drawings.

The shafts 1,2 are horizontally disposed within housing 3 in the flow chamber 3*a* having an inlet opening 6 in the top of the housing 3 for introduction of the cellulosic material to be worked, and twin semicircular outlet openings 7,8 through which the ends of each shaft 1,2 project. The pitch of the blades is selected to carry the cellulosic material along the chamber from the inlet 6 to the outlets 7,8. The end wall 9 of the housing 3 is drawn in at the outlets 7,8 so as to restrict the outward flow of the worked cellulosic material from the chamber 3*a*, and, thus impart a degree of axial compression to the mass of cellulosic material being worked in the chamber 3*a*.

Each shaft 1,2 carries a concentric cylinder 1*a*,2*a*, and to the external peripheries of these cylinders 1*a*,2*a*are affixed the helical blades 4,5, respectively, which extend along the major portion of the length of the shaft 1,2 within and from one end to the other of the chamber 3*a*. The helical blades may be permanently or removably affixed to the cylinders 1*a*,2*a*, and extend outwardly to closely abut but not touch the internal walls of the housing 3, to facilitate transport of the cellulosic material being worked by the screws while rotating through the chamber 3*a* from the inlet 6 to the outlets 7,8.

Mechanical means for narrowing or widening the outlet openings 7,8 as shown in Swedish Pat. No. 314,288 displaces the end wall 9. In the portion abutting the outlets 7,8, the cylinders 1*a*,2*a* carry another screw section 10,11, which transport the worked cellulosic material delivered by the screw portions 4*a*,5*a* through the outlet and discharge it from the housing.

Each helical blade 4,5 is in two sections, 4*a*,4*b* and 5*a*,5*b*. In each section, helical grooves 4*c*,5*c* extend around the screw between the blade portions. The blade portions 4*b*,5*b* adjacent the inlet 6 extend to approximately the center of the chamber 3*a*, with a pitch that decreases progressively from the inlet towards the outlet. They merge with the next sections 4*a*,5*a*, which extend to the second screws 10,11. In the sections 4*a*,5*a* the pitch is constant, although smaller than the pitch in the forward sections 4*b*,5*b*.

As seen in FIG. 1, the external peripheries of the blades 4,5 in sections 4*b*,5*b* are smooth and continuous, and shaped so as to closely conform to the walls of the chamber 3*a*. In the sections 4*a*,5*a*, however, the external peripheries of the blades are in an undulating hill-and-dale configuration, with successive recesses 13,14 and projections 15,16. The recesses are in the form of straight-sided substantially triangular notches, and the projections are straight-sided extensions of the notch walls with blunt tips that extend close to but do not touch the external surfaces of the cyliders 1*a*,2*a*. As seen in FIG. 2 the cylinders 1*a*,2*a* have undulating surfaces with rounded projections 17,18 integral therewith that extend nearly to the bases of the recesses 13,14, in the helical blades 4*a*,5*a*, and with spaces 17*a*, 18*a* between the projections.

The helical blades 4,5 have straight sides also, but in a cross-sectional configuration corresponding to an outwardly tapering, substantially parallel trapezoid, with the side surface of the blade inclined to the radial plane at an angle within the range from about 5°to about 15° and preferably about 10°.

The cross-sectional configuration of the helical blades and the pitch of the blades in the first sections 4*b*,5*b* are so selected that there is no appreciable compression of the cellulosic material in the grooves 4*c*,5*c* in that region, in the bite region B between the screws. However, in the next sections 4*a*,5*a*, the pitch and cross-sectional dimensions of the helical blades are carefully selected to provide compression of the cellulosic material in the grooves 4*c*,5*c* between the side surfaces of the interdigitating helical blade sections in the bite B of the screws, as well as between the projections 15,16 on the outer peripheries of the blades and the projections 17,18 on cylinders 1*a*,2*a* in the grooves 4*c*,5*c* between the helical blades.

There should be a minimum clearance of at least 2mm between all opposing surfaces in the bite region B between the screws. This spacing is increased or decreased, as may be required, in order to prevent undue cutting and shortening of the cellulosic fibers during the working by the screws.

The axial clearance between the outer periphery of the helical blade and the bottom of the groove into which it dips is usually within the range from about 1 to about 20%, preferably from about 3 to about 7%, of the breadth of the blade, from the bottom of the groove to the outer periphery of the blade.

The clearance between the outermost surface of the projections or beads and the bottom of the groove in which the projections or beads are placed is within the range from about 10 to about 60%, preferably from about 10 to about 40%, of the breadth of the helical blade, from the bottom of the groove to the outer peiphery of the blade.

In the sections 4*a*, 5*a* the width of the blades at their tips is only a fraction of the pitch of the blades in this region. This is of considerable importance in controlling the degree of compression of the cellulosic material in the bite between the screws, since the openspace between the tips and sides of each blade in the grooves 4*c*, 5*c* is of course filled with cellulosic material The ratio of the height of the helical blade to the pitch thereof in the sections 4*a*, 5*a* is important in controlling the extent to which the cellulosic material is carried along by the screw. This ratio is preferably not lower than 3:2. A preferred ratio is 2:1.

As best seen in FIG. 2, the projecing portions 17, 18 on the cylinders 1*a*, 2*a* are arranged opposite each peripheral recess 13, 14 on the sections 4*a*, 5*a* of the helical blades of the intermeshing screw. In this instance, the projections 17, 18 are rounded, in the form of hemicircular rods or beads, and the beads extend axially in parallel with the shafts 1, 2 at the base of the grooves 4*c*, 5*c* of each screw between the helical blade portions along the entire length of the sections 4*a*, 5*a*. The height and width of the projections 17, 18 can be between two-thirds to one-third to one-half of the height of the blade, and in the embodiment shown in the drawing are one-third and one-quarter of this height, respectively.

It will be noted that in the bite of the screws the projecting portions 15, 16 of each blade 4*a*, 5*a* extend into the spaces 17*a*, 18*a* between the projections 17, 18, but do not contact the base of these spaces. Neither do the tips of the projections 15, 16 touch the tops of the projections 17, 18. There is a small clearance of more than 2 mm in each of these locations. At the same time, however, the projections 15, 16 substantially fill the spaces 17*a*, 18*a* and the projections 17, 18 substantially fill recesses 13, 14, as well, giving to the blades in the bite between the screws a filled-in configuration approximating that of the continuous blade portions 4*b*, 5*b*, as seen in FIG. 1.

The operation of the apparatus of FIGS. 1 and 2 is as follows: Rotation of screws is started up, in the direction shown by the arrows in FIG. 2. Cellulosic material then is fed through the inlet 6 into the chamber 3*a* of the housing 3. At this stage the cellulosic material is nonflowable, and has a concentration or consistency of more than 12.5% solids and preferably above 25% solids. A s the cellulosic material is carried by the rotating screws along the sections 4*b*, 5*b*, it is compacted in a manner such that the grooves 4*c*, 5*c* are filled by cellulosic material. Because of the adhesion of this material to the walls of the grooves, and because the cellulosic material as a result of this consistency is packed to a coherent mass, the cellulosic material in the grooves is carried along with the screws, and is forced to pass repeatedly into the bite in the region B between the screws, as shown in FIG. 1.

The speed at which the cellulosic material passes through the working zone B of chamber 3*a*, the bite region between the screws is determined by the in-feed flow and the out-feed flow, and the latter in turn is determined by the through-flow areas of the outlet openings, as well as the pitch and speed at which the screws are rotated, and the flow properties of the cellulosic material itself. The longer the cellulosic material remains in the apparatus, the greater the working. Thus, it is important that the through-flow areas of the outlet openings 7, 8 be controlled to give a material having uniform properties as it emerges from the working zone.

Since the peripheral speed is much greater at the external periphery of the helical blades than at the bottom of the grooves, the cellulosic material within the recesses 13, 14 in the sections 4*a*, 5*a* will agglomerate and be compressed in a radial direction towards the bottom of the grooves, and at the same time it will be subjected to a rolling, kneading, mixing and shearing treatment. The radially directed compression and working of the cellulosic material in the bite of the screws in the region of the recesses 13, 14 not only result in the defibration of the cellulosic material, but also impart a permanent crimp to the exposed fibers, so that they become matted in an irregular array of low density and high open volume. The worked pulp displays a low density and high specific volume, in consequence, which renders it particularly suitable for use as an absorbent material in diapers and sanitary napkins.

A further highly specific working effect is obtained by the interaction of the projections 17, 18 in the grooves 4*c*, 5*c* with the recesses 13, 14 of the intermeshing helical blade. In the bite of the screws, the beads 17, 18 fit into the recesses 13, 14 in an intermeshing manner, which supplements the interdigitating bite. In this way, the amount of cellulosic material which tends to accompany the helical blade during its rotation is decreased. This gives an increase in the flow rate through the chamber 3*a*. In consequence, the projections 17, 18 make it possible to employ larger recesses 13, 14 than would otherwise have been possible, without reducing the flow rate of the cellulosic material through the apparatus. At the same time, an increased radial compression of the cellulosic material is obtained, with the result that a well defibrated and conditioned pulp is obtained, with a strongly reduced fiber knot content, while at a high throughput (and work capacity) per unit time.

The following Example illustrates the advantages of the apparatus of the invention as applied to a sulfate knot pulp. For comparison purposes, comparative data was obtained using a like apparatus which did not contain the projections 17, 18, but otherwise identical in every other respect, including the pitch and dimensions of the helical blades and the grooves therebetween.

EXAMPLE

A sulfate knot pulp having 4.8% by weight fiberknots and a solids content of approximately 30% was divided into two equal parts. One part was fed into the apparatus shown in FIGS. 1 and 2, while the other part was fed into a control apparatus identical thereto in every respect, but without the projections 17, 18.

The amount of pulp charged to the apparatus per unit time, the screw pitch and length, and the open area of the outlets of the apparatus as well as the processing conditions were the same for each apparatus.

The following results were obtained:

TABLE I

| | Fiber-Knot content of the untreated pulp | Fiber-knot content of the treated pulp | Reduction in the fiber-knot content | Energy consumed per ton of pulp |
|---|---|---|---|---|
| The apparatus of FIGS. 1 and 2 | 4.8% | 0.98% | 79.5% | 323 kWh |
| The control apparatus without projections and recesses in the grooves | 4.8% | 1.8% | 62.5% | 236 kWh |

It is apparent that the addition of projections 17, 18 and recesses 17*a*, 18*a* in the grooves 4*c*, 5*c* intermeshing with projections 15, 16 cuts fiber-knot content by a further 17%.

Various modifications can be made in the apparatus of the invention as shown in FIGS. 1 and 2. As FIGS. 3 and 4 show, the projections or beads need not be arranged only along the bottoms of the helical grooves 4*c*, 5*c*, and supported at the bottom or on the helical blades or on both, but they also can be spaced from the bottom and carried on the helical blades. FIG. 3 shows one embodiment of this type in which the beads 19, 20 are spaced at approximately one-third of the height of the blades from the base of the grooves. In this arrangement they reach deeper into the recesses 13, 14 than do the projections 17, 18 of FIGS. 1 and 2.

In the embodiment shown in FIG. 3, the projections or beads are placed opposite and at approximately the base of the recesses 13, 14. It is also possible to place the beads so that they are located between the recessed, spanning the projections on the blades.

Such an embodiment is shown in FIG. 4. Here, the beads 21 extend between the turnings of the helical blades well above the base of the recesses, approximately half way up the projections 15. In FIG. 4, the helical section 4*a* is shown without the shaft. The rods 21 are of course arranged in the grooves 4*c* about the screw axis with the same spacing therebetween at 23 as the projections in the outer periphery of the helical blade of the opposite screw, but offset so that the peripheral projections of the blade of that screw intermesh with the spaces 23, and the recesses of the blade intermesh with the rods 21.

When the projections are spaced from the base of the groove, they can, for example, be formed (as shown in FIG. 4) as rods 21 which extend axially through apertures 22 in the blades 4 from end to end of this section of the helical blade, and are removably attached thereto at each end by, for example, cap nuts or cotter pins. Such rods can easily be replaced whenever required. However, it is also possible to arrange the rods or beads at short lengths spanning only the widths of the grooves between helical blade portions in which they are placed. Such short rods whether of metal or plastic are best permanently attached to the shaft by welding, soldering, brazing, bonding, or screwing.

The projections or beads also can extend only part of the way across the grooves. The projections can be attached to the helical blades, or the axial screw shaft, or both, projecting all or part way across the groove and/or upwardly into the groove from the bottom, or at any angle to the blade sides and bottom of the groove.

In the embodiment illustrated in FIG. 5, the projections 22,23 are mounted on axial shafts 1', 2' and project outwardly therefrom into the grooves 4'*c*, 5'*c* between the helical blades 4'*a*, 5'*a*, and extend only part way across the grooves. These projections and the recesses therebetween intermesh with the recesses 13, 14 and projections 15, 16 of the blades, as in the previous embodiment.

the beads or rods or other form of projection can be made to increase or decrease in size along sections 4*a*, 5*a*, and to be spaced at different distances from the bottom of the grooves. They can be smooth-surfaced, as shown. They can also be provided with corrugated or serrated surfaces in order to increase the compressive effect upon the cellulosic material being worked in the bite of the screws. Similarly, the intermeshing peripheral surfaces of the projecions and recesses formed on the opposed helical blades may also be serrated or corrugated. The serrations or corrugations can be arranged on separate elements which are removably attached to the peripheral edges of the helical blades, with the elements of one projection abutting the elements on the opposing recess in the grooves of the other screw. One advantage of this mode of attachment is that the serrated surface can readily be replaced when worn, or by serrations of a different type, substituted for special effects, according to the cellulosic material being worked.

FIGS. 6 to 9 show various embodiments of serrated projections and serrated helical blades.

In FIG. 6 the projections are in the form of axial rods 27 located at the base of the grooves in the helical blades 4*a*, 5*a*, as in the embodiment of FIG. 3, and are provided with integral axial serrations 27*a*, extending along their surfaces in parallel to the screw shafts 1, 2.

In the embodiment of FIG. 7, the projections are in the form of ridges 26 projecting from the cylinders 1*a*, 2*a*, extending axially and radially outward, as in the embodiment of FIG. 2, provided with integral axial serrations 26*a* in parallel to the screw shafts 1, 2.

In the embodiment shown in FIG. 8, the serrations are on the surfaces of the blades 4*a*, 5*a* in the form of removable serrated members 25, which extend along the teeth of the blades 4*a*, 5 *a* to points just short of the truncated tips 25*a* and bases 25*b* of the blade serrations. The members 25 are affixed to the blade edges by bolts 25 which screw into sockets 25*d* in the blades. The serrations are integral, and extend axially in parallel to the screw shafts 1, 2. A detailed view of one serrated member 25 is given in FIG. 9, showing the apertures 25*f* through which the bolts 25*c* pass.

In the embodiment shown in FIG. 10, the projections are in the form of rods 28 extending axially from end to end of the sections 4*a*, 5*a* as in the embodiment of FIG. 4, but increase gradually in diameter towards the outlet from the chamber, rods 28*a* being appreciably larger than rods 28*b*. Projections which decrease in size towards the outlet have exactly the same configuration and can be obtained by simply reversing the blades as shown in FIG. 10 between the screws and on the shafts 1, 2 so that they face in the opposite direction along the axial shaft, and have a reverse pitch as well.

Having regard to the foregoing disclosure, the following is claimed as inventive and patentable embodiments thereof:

1. Apparatus for the defibration and conditioning of nonflowable cellulosic material comprising a housing having an inlet and an outlet and a flow chamber for cellulose material therebetween; two screws disposed in the chamber and extending from the inlet to the outlet, the screws having interdigitating helical blades with opposed pitches, and helical grooves therebetween interdigitatingly receiving the helical blades of the opposite screws; the screws being arranged for interdigitating rotational movement in opposite directions, so as to defibrate and condition cellulosic material in the bite therebetween while carrying the material through the flow chamber from the inlet towards the outlet; at least a portion of the outer periphery of each helical blade being undulating in a plurality of successive recesses and projections, intermeshing short of contact with a like plurality of projections and recesses defining a land area in the groove of the opposite blade of the other screw, so that within the land areas in the bite of the screws the intermeshing projections of one groove occupy at least part of the recesses in the blade of the other screw, to extend the filled-in area of the blade surface along each screw, for improved screw efficiency in defibration and conditioning of the cellulosic material, and transport of the material through the flow chamber.

2. Apparatus according to claim 1 in which the intermeshing of like projections and recesses in the helical blades and grooves of opposed screws is sufficiently complete to make possible an additional stage of radial compression at the peripheries of the blade between the intermeshing projections and recesses themselves.

3. Apparatus according to claim 1 in which the screws comprise rotatable screw shafts enclosed in cylinders rotatable therewith, and the intermeshing sets of recesses and projections in the helical grooves of each screw are provided at the base of the grooves by an undulating surface on the cylinder enclosing the screw shaft.

4. Apparatus according to claim 1 in which the intermeshing set of recesses and projections define a land area in the grooves that is spaced from the bottom of the grooves, and is in the form of rods extending axially between adjacent helical blade portions opposite the base of recessed portions of the blades, and serving as projections, and spaces between the rods serving as recesses.

5. Apparatus according to claim 1 in which the intermeshing set of recesses and projections define a land area in the grooves that is spaced from the bottom of the grooves, and is in the form of rods extending axially between projections on the adjacent helical blade portions and serving as projections, and spaced between the rods and recesses.

6. Apparatus according to claim 1 in which the projections are in the form of beads fixedly mounted in the grooves.

7. Apparatus according to claim 6 in which the beads are spaced radially from the base of the grooves and are fixedly mounted between adjacent helical blade portions.

8. Apparatus according to claim 6 in which the beads extend along the screw shaft the entire length of the helical blade portion in which the periphery of the blade is undulating.

9. Apparatus according to claim 6 in which the beads extend axially of the screw through openings in the adjacent helical blade portions.

10. Apparatus according to claim 6 in which the beads increase in size in the direction towards the outlet of the chamber.

11. Apparatus according to claim 6 in which the beads decrease in size in the direction towards the outlet of the chamber.

12. Apparatus according to claim 1 in which the projections and recesses themselves have undulating projections and recesses on their peripheries.

13. Apparatus according to claim 12 in which the undulating form constitutes serrations.

14. Apparatus according to claim 12 in which the undulating peripheral surfaces are arranged on removable elements mounted on the projections and recesses.

15. Appparatus according to claim 14 in which the adjacent elements abut one another.

16. Apparatus according to claim 1 in which the projections are removably mounted in the grooves.

17. Apparatus according to claim 1 in which the projections defining land areas in the groove of the opposite blade extend all the way across the groove.

18. Apparatus according to claim 1 in which the projections defining land areas in the groove of the opposite blade extend only part of the way across the groove.

19. Apparatus according to claim 1 in which the projections defining land areas in the groove of the opposite blade extend upwardly from the bottom of the groove.

20. Apparatus according to claim 1 in which the projections defining land areas in the groove of the opposite blade extend into the groove from the helical blade.

* * * * *